US010167707B2

(12) United States Patent
Trapani et al.

(10) Patent No.: US 10,167,707 B2
(45) Date of Patent: Jan. 1, 2019

(54) ROD STRING ROTATION DURING WELL PUMPING OPERATIONS

(71) Applicant: WEATHERFORD TECHNOLOGY HOLDINGS, LLC, Houston, TX (US)

(72) Inventors: James S. Trapani, Houston, TX (US); Clark E. Robison, Tomball, TX (US); Jeffrey J. Lembcke, Cypress, TX (US); Benson Thomas, Pearland, TX (US); Kyle C. Brosch, Richmond, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 261 days.

(21) Appl. No.: 14/964,913

(22) Filed: Dec. 10, 2015

(65) Prior Publication Data

US 2017/0167236 A1 Jun. 15, 2017

(51) Int. Cl.

| | |
|---|---|
| ***E21B 43/12*** | (2006.01) |
| ***F04B 53/10*** | (2006.01) |
| ***F04B 47/02*** | (2006.01) |

(52) U.S. Cl.

CPC ..... *E21B 43/127* (2013.01); *F04B 47/02* (2013.01); *F04B 47/026* (2013.01); *F04B 53/10* (2013.01)

(58) Field of Classification Search

CPC ..... E21B 43/12; E21B 43/127; E21B 33/03

See application file for complete search history.

(56) References Cited

U.S. PATENT DOCUMENTS

| | | | | |
|---|---|---|---|---|
| 6,155,792 | A * | 12/2000 | Hartley | F04B 47/06 165/119 |
| 7,857,043 | B2 | 12/2010 | Ali-Zada et al. | |
| 9,140,113 | B2 | 9/2015 | Hurst et al. | |
| 2004/0140087 | A1 * | 7/2004 | Ferguson | E21B 23/006 166/68.5 |

OTHER PUBLICATIONS

Weatherford; "Intelligent Rod Rotator", company article 10866.00, dated 2013, 8 pages.

Specification and Drawings for U.S. Appl. No. 14/947,919, filed Nov. 20, 2015, 38 pages.

Office Action dated Apr. 19, 2018 for U.S. Appl. No. 14/947,919, 19 pages.

* cited by examiner

*Primary Examiner* — Giovanna C. Wright
*Assistant Examiner* — Manuel C Portocarrero
(74) *Attorney, Agent, or Firm* — Smith IP Services, P.C.

(57) ABSTRACT

A well pumping system can include an actuator that reciprocates a rod string, and a rod rotator including at least one helical profile and at least one engagement device. The rod string may rotate in response to longitudinal displacement of the rod string while the engagement device is engaged with the helical profile. A method of rotating a rod string in a well can include rotating a rod in a rotary direction, in response to displacement of the rod in a longitudinal direction, and preventing rotation of the rod in an opposite rotary direction, in response to displacement of the rod in an opposite longitudinal direction.

20 Claims, 12 Drawing Sheets

ROD STRING ROTATION DURING WELL PUMPING OPERATIONS

BACKGROUND

This disclosure relates generally to equipment utilized and operations performed in conjunction with a subterranean well and, in one example described below, more particularly provides a well pumping system and associated method.

Reservoir fluids can sometimes flow to the earth's surface when a well has been completed. However, with some wells, reservoir pressure may be insufficient (at the time of well completion or thereafter) to lift the fluids (in particular, liquids) to the surface. In those circumstances, technology known as "artificial lift" can be employed to bring the fluids to or near the surface (such as a subsea production facility or pipeline, a floating rig, etc.).

Various types of artificial lift technology are known to those skilled in the art. In one type of artificial lift, a downhole pump is operated by reciprocating a string of "sucker" rods deployed in a well. An apparatus (such as, a walking beam-type pump jack or a hydraulic actuator) located at the surface can be used to reciprocate the rod string.

Therefore, it will be readily appreciated that improvements are continually needed in the arts of constructing and operating artificial lift systems. Such improvements may be useful for lifting oil, water, gas condensate or other liquids from wells, may be useful with various types of wells (such as, gas production wells, oil production wells, water or steam flooded oil wells, geothermal wells, etc.), and may be useful for any other application where reciprocating motion is desired.

DETAILED DESCRIPTION

Figure 1:
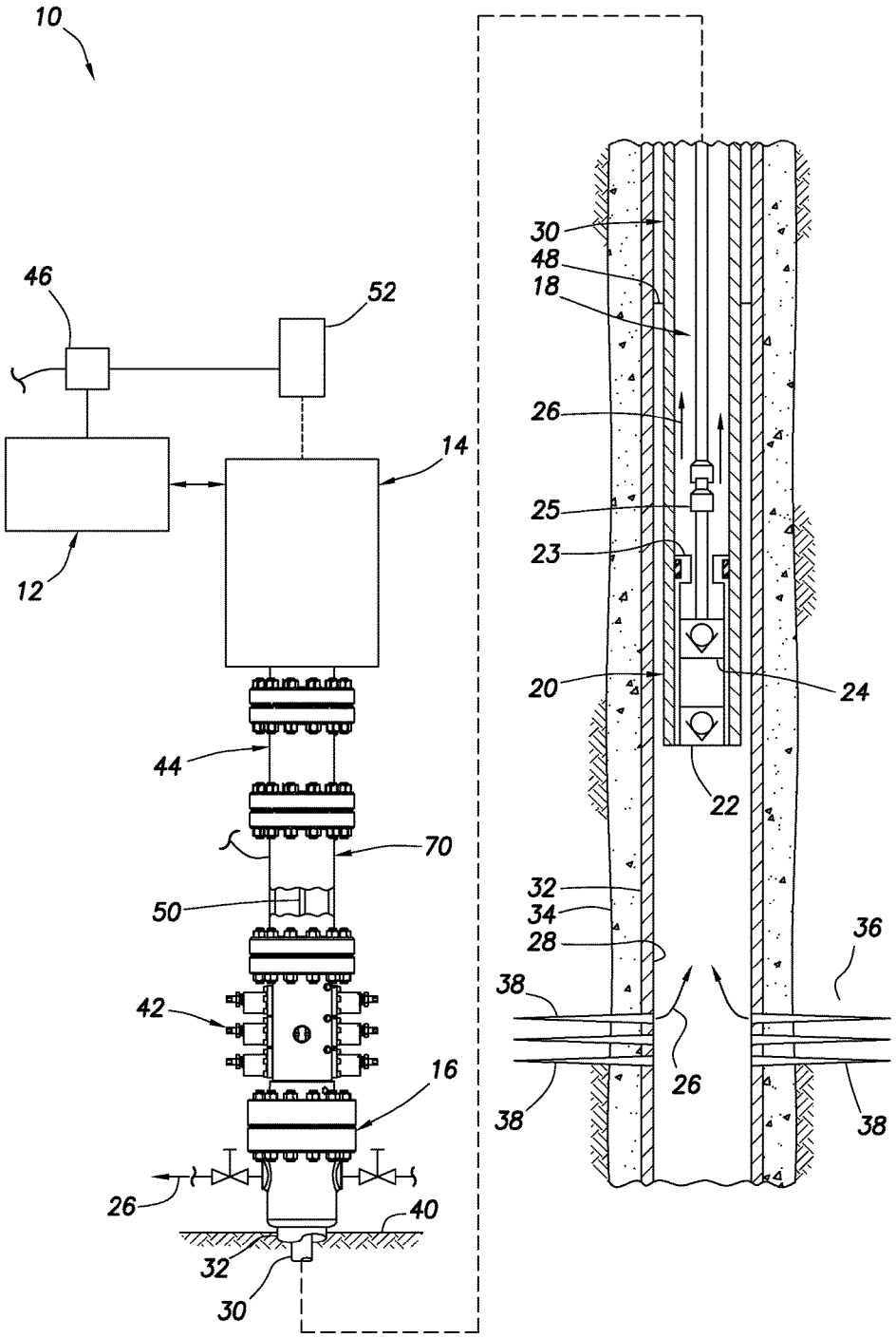
FIG. 1 is a representative partially cross-sectional view of an example of a well pumping system and associated method which can embody principles of this disclosure.

Representatively illustrated in FIG. 1 is a well pumping system 10 and associated method for use with a subterranean well, which system and method can embody principles of this disclosure. However, it should be clearly understood that the well pumping system 10 and method are merely one example of an application of the principles of this disclosure in practice, and a wide variety of other examples are possible. Therefore, the scope of this disclosure is not limited at all to the details of the system 10 and method as described herein or depicted in the drawings.

In the FIG. 1 example, a power source 12 is used to supply energy to an actuator 14 mounted on a wellhead 16. In response, the actuator 14 reciprocates a rod string 18 extending into the well, thereby operating a downhole pump 20.

The rod string 18 may be made up of individual sucker rods connected to each other, although other types of rods or tubes may be used, the rod string 18 may be continuous or segmented, a material of the rod string 18 may comprise steel, composites or other materials, and elements other than rods may be included in the string. Thus, the scope of this disclosure is not limited to use of any particular type of rod string, or to use of a rod string at all. It is only necessary for purposes of this disclosure to communicate reciprocating motion of the actuator 14 to the downhole pump 20, and it is therefore within the scope of this disclosure to use any structure capable of such transmission.

The downhole pump 20 is depicted in FIG. 1 as being of the type having a stationary or "standing" valve 22 and a reciprocating or "traveling" valve 24. The traveling valve 24 is connected to, and reciprocates with, the rod string 18, so that fluid 26 is pumped from a wellbore 28 into a production tubing string 30. However, it should be clearly understood that the downhole pump 20 is merely one example of a wide variety of different types of pumps that may be used with the well pumping system 10 and method of FIG. 1, and so the scope of this disclosure is not limited to any of the details of the downhole pump described herein or depicted in the drawings.

The wellbore 28 is depicted in FIG. 1 as being generally vertical, and as being lined with casing 32 and cement 34. In other examples, a section of the wellbore 28 in which the pump 20 is disposed may be generally horizontal or otherwise inclined at any angle relative to vertical, and the wellbore section may not be cased or may not be cemented. Thus, the scope of this disclosure is not limited to use of the well pumping system 10 and method with any particular wellbore configuration.

In the FIG. 1 example, the fluid 26 originates from an earth formation 36 penetrated by the wellbore 28. The fluid 26 flows into the wellbore 28 via perforations 38 extending through the casing 32 and cement 34. The fluid 26 can be a liquid, such as oil, gas condensate, water, etc. However, the scope of this disclosure is not limited to use of the well pumping system 10 and method with any particular type of fluid, or to any particular origin of the fluid.

As depicted in FIG. 1, the casing 32 and the production tubing string 30 extend upward to the wellhead 16 at or near the earth's surface 40 (such as, at a land-based wellsite, a subsea production facility, a floating rig, etc.). The production tubing string 30 can be hung off in the wellhead 16, for example, using a tubing hanger (not shown in FIG. 1, see FIG. 4). Although only a single string of the casing 32 is illustrated in FIG. 1 for clarity, in practice multiple casing strings and optionally one or more liner strings (a liner string being a pipe that extends from a selected depth in the wellbore 28 to a shallower depth, typically sealingly "hung off" inside another pipe or casing) may be installed in the well.

In the FIG. 1 example, a rod blowout preventer stack 42 and a stuffing box 44 are connected between the actuator 14 and the wellhead 16. The rod blowout preventer stack 42 includes various types of blowout preventers (BOP's) configured for use with the rod string 18. For example, one blowout preventer can prevent flow through the blowout preventer stack 42 when the rod string 18 is not present therein, and another blowout preventer can prevent flow through the blowout preventer stack 42 when the rod string 18 is present therein. However, the scope of this disclosure is not limited to use of any particular type or configuration of blowout preventer stack with the well pumping system 10 and method of FIG. 1.

The stuffing box 44 includes an annular seal (not visible in FIG. 1) about an upper end of the rod string 18. A reciprocating rod 50 forms an upper section of the rod string 18 below the annular seal, although in other examples a connection between the rod 50 and the rod string 18 may be otherwise positioned.

In some examples, a rod of the type known to those skilled in the art as a "polished rod" suitable for sliding and sealing engagement within the annular seal in the stuffing box 44 may be connected above the rod 50. The polished rod may be a component of the actuator 14, such as, a rod extending downwardly from a piston of the actuator (see FIG. 2).

The power source 12 may be connected directly to the actuator 14, or it may be positioned remotely from the actuator 14 and connected with, for example, suitable electrical cables, mechanical linkages, hydraulic hoses or pipes. Operation of the power source 12 is controlled by a control system 46.

The control system 46 may allow for manual or automatic operation of the actuator 14 via the power source 12, based on operator inputs and measurements taken by various sensors. The control system 46 may be separate from, or incorporated into, the actuator 14 or the power source 12. In one example, at least part of the control system 46 could be remotely located or web-based, with two-way communication between the actuator 14, the power source 12 and the control system 46 being via, for example, satellite, wireless or wired transmission.

The control system 46 can include various components, such as a programmable controller, input devices (e.g., a keyboard, a touchpad, a data port, etc.), output devices (e.g., a monitor, a printer, a recorder, a data port, indicator lights, alert or alarm devices, etc.), a processor, software (e.g., an automation program, customized programs or routines, etc.) or any other components suitable for use in controlling operation of the actuator 14 and the power source 12. The scope of this disclosure is not limited to any particular type or configuration of a control system.

In operation of the well pumping system 10 of FIG. 1, the control system 46 causes the power source 12 to increase energy input to the actuator 14, in order to raise the rod string 18. Conversely, the energy input to the actuator 14 is reduced or removed, in order to allow the rod string 18 to descend. Thus, by alternately increasing and decreasing energy input to the actuator 14, the rod string 18 is reciprocated, the downhole pump 20 is actuated and the fluid 26 is pumped out of the well.

It can be advantageous to control a reciprocation speed of the rod string 18, instead of reciprocating the rod string as fast as possible. For example, a fluid interface 48 in the wellbore 28 can be affected by the flow rate of the fluid 26 from the well. The fluid interface 48 could be an interface between oil and water, gas and water, gas and gas condensate, gas and oil, steam and water, or any other fluids or combination of fluids.

If the flow rate is too great, the fluid interface 48 may descend in the wellbore 28, so that eventually the pump 20 will no longer be able to pump the fluid 26 (a condition known to those skilled in the art as "pump-off"). On the other hand, it is typically desirable for the flow rate of the fluid 26 to be at a maximum level that does not result in pump-off. In addition, a desired flow rate of the fluid 26 may change over time (for example, due to depletion of a reservoir, changed offset well conditions, water or steam flooding characteristics, etc.).

A "gas-locked" downhole pump 20 can result from a pump-off condition, whereby gas is received into the downhole pump 20. The gas is alternately expanded and compressed in the downhole pump 20 as the traveling valve 24 reciprocates, but the fluid 26 cannot flow into the downhole pump 20, due to the gas therein.

In the FIG. 1 well pumping system 10 and method, the control system 46 can automatically control operation of the actuator 14 via the power source 12 to regulate the reciprocation speed, so that pump-off is avoided, while achieving any of various desirable objectives. Those objectives may include maximum flow rate of the fluid 26, optimized rate of electrical power consumption, reduction of peak electrical loading, etc. However, it should be clearly understood that the scope of this disclosure is not limited to pursuing or achieving any particular objective or combination of objectives via automatic reciprocation speed regulation by the control system 46.

As mentioned above, the power source 12 is used to variably supply energy to the actuator 14, so that the rod string 18 is displaced alternately to its upper and lower stroke extents. These extents do not necessarily correspond to maximum possible upper and lower displacement limits of the rod string 18 or the pump 20.

For example, it is typically undesirable for a valve rod bushing 25 above the traveling valve 24 to impact a valve rod guide 23 above the standing valve 22 when the rod string 18 displaces downward (a condition known to those skilled in the art as "pump-pound"). Thus, it is preferred that the rod string 18 be displaced downward only until the valve rod bushing 25 is near its maximum possible lower displacement limit, so that it does not impact the valve rod guide 23.

On the other hand, the longer the stroke distance (without impact), the greater the productivity and efficiency of the pumping operation (within practical limits), and the greater the compression of fluid between the standing and traveling valves 22, 24 (e.g., to avoid gas-lock). In addition, a desired stroke of the rod string 18 may change over time (for example, due to gradual lengthening of the rod string 18 as a result of lowering of a liquid level (such as at fluid interface 48) in the well, etc.).

In the FIG. 1 well pumping system 10 and method, the control system 46 can automatically control operation of the power source 12 to regulate the upper and lower stroke extents of the rod string 18, so that pump-pound is avoided, while achieving any of various desirable objectives. Those objectives may include maximizing rod string 18 stroke length, maximizing production, minimizing electrical power consumption rate, minimizing peak electrical loading, etc. However, it should be clearly understood that the scope of this disclosure is not limited to pursuing or achieving any particular objective or combination of objectives via automatic stroke extent regulation by the control system 46.

In the FIG. 1 example, the system 10 includes a continuous position sensor 52 in communication with the control system 46. The continuous position sensor 52 is capable of continuously detecting a position of a reciprocating member at or near the surface 40 (such as, the piston or piston rod of the actuator 14 (see FIG. 2), the rod 50 or another member).

An output of the continuous position sensor 52 can be useful to achieve a variety of objectives, such as, controlling stroke distance, speed and extents to maximize production and efficiency, minimize electrical power consumption and/or peak electrical loading, maximize useful life of the rod string 18, etc. However, the scope of this disclosure is not limited to pursuing or achieving any particular objective or combination of objectives via use of a continuous position sensor.

As used herein, the term "continuous" is used to refer to a substantially uninterrupted sensing of position by the sensor 52. For example, when used to continuously detect the position of the rod 50, the sensor 52 can detect the rod's position during all portions of its reciprocating motion, and not just at certain discrete points (such as, at the upper and lower stroke extents). However, a continuous position sensor may have a particular resolution (e.g., 0.001-0.1 mm) at which it can detect the position of a member. Accordingly, the term "continuous" does not require an infinitely small resolution.

Using the continuous position sensor 52, the control system 46 can be provided with an accurate measurement of a reciprocating member position at any point in the member's reciprocation, thereby dispensing with any need to perform calculations based on discrete detections of position. It will be appreciated by those skilled in the art that actual continuous position detection can be more precise than such calculations of position, since various factors (including known and unknown factors, such as, temperature, fluid compressibility, fluid leakage, etc.) can affect the calculations.

By continuously sensing the position of a reciprocating member at or near a top of the rod string 18, characteristics of the rod string's reciprocating displacement are communicated to the control system 46 at each point in the rod string's reciprocating displacement. The control system 46 can, thus, determine whether the rod string's 18 position, speed and acceleration correspond to desired preselected values.

If there is a discrepancy between the desired preselected values and the rod string's reciprocating displacement as detected by the sensor 52, the control system 46 can change how energy is supplied to the actuator 14 by the power source 12, so that the reciprocating displacement will conform to the desired preselected values. For example, the control system 46 may change a level, timing, frequency, duration, etc., of the energy input to the actuator 14, in order to change the rod string's upper or lower stroke extent, or velocity or acceleration at any point in the rod string's reciprocating displacement.

Note that the desired preselected values may change over time. As mentioned above, it may be desirable to change the upper or lower stroke extent, or the pumping rate, during the pumping operation, for example, due to the level of the fluid interface 48 changing, reservoir depletion over time, detection of a pump-off, pump-pound or gas-lock condition, etc.

Although the continuous position sensor 52 provides certain benefits in the system 10 and method example of FIG. 1, it should be clearly understood that it is not necessary in keeping with the scope of this disclosure for a continuous position sensor or any other particular type of sensor to be used.

It can be advantageous to rotate the rod string 18 during the pumping operation, for example, to more evenly distribute wear on the rod string. As mentioned above, the rod string 18 may extend through deviated or horizontal sections of the wellbore 28, and can rub against an inner surface of the tubing string 30 in those sections.

For this reason and others, the system 10 includes a rod rotator 70 connected between the stuffing box 44 and the blowout preventer stack 42. In other examples, the rod rotator 70 could be incorporated into either of the stuffing box 44 or the blowout preventer stack 42, or could be otherwise located, and so the scope of this disclosure is not limited to any particular placement or configuration of the rod rotator.

The rod rotator 70 in the FIG. 1 example is connected to the control system 46. In this manner, rotation of the rod 50 (and the rod string 18) can be effectively coordinated with the reciprocating displacement. Because the position sensor 52 provides the control system 46 with a continuous position output for the reciprocating displacement, operation of the rod rotator can be more effectively controlled by the control system, as described more fully below.

Figure 2:
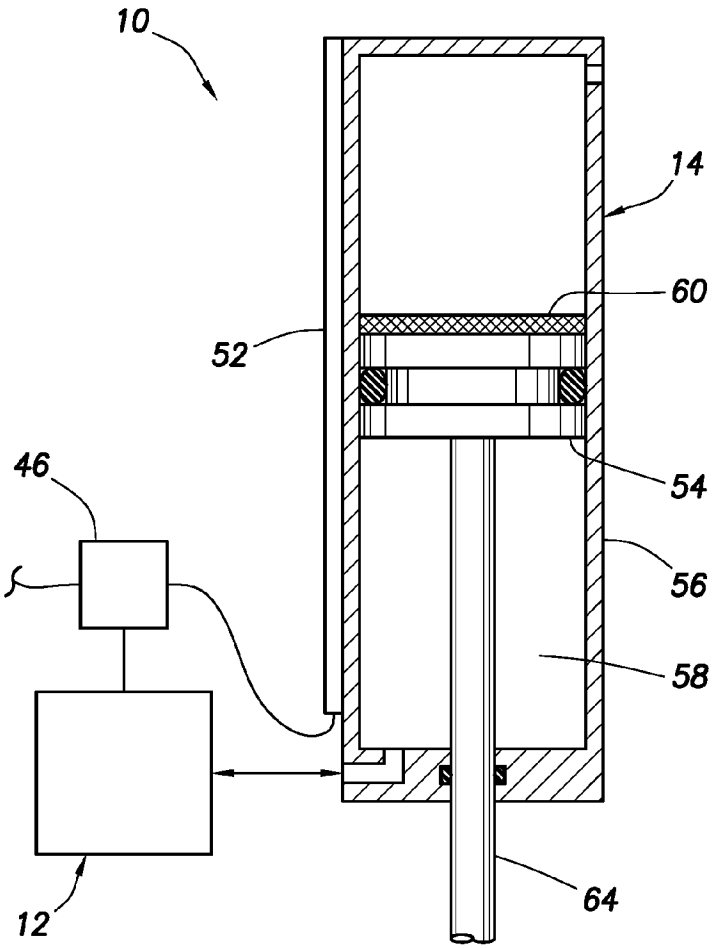
FIG. 2 is a representative partially cross-sectional view of an actuator that may be used with the system and method of FIG. 1.

Referring additionally now to FIG. 2, an example of the actuator 14 that may be used with the system 10 and method is representatively illustrated. The actuator 14 in this example is a single-acting hydraulic actuator, but other types of actuators may be used (such as, mechanical, electrical, double-acting hydraulic, accumulator-balanced hydraulic, etc.). Thus, the scope of this disclosure is not limited to use of any particular type of actuator.

In the FIG. 2 example, the actuator 14 includes a piston 54 sealingly and reciprocably disposed in a generally cylindrical housing 56. A piston rod 64 is connected to the piston 54 and extends downwardly through a lower end of the housing 56. The piston rod 64 may be connected to the rod 50 (such as, below the annular seal in the stuffing box 44), or in some examples they may be a single member.

The power source 12 in this example comprises a hydraulic pressure source (such as, a hydraulic pump and associated equipment) for supplying energy in the form of fluid pressure to a chamber 58 in the housing 56 below the piston 54. To raise the piston 54, the piston rod 64, the rod 50 and the rod string 18, hydraulic fluid at increased pressure is supplied to the chamber 58 from the power source 12. To cause the piston 54, piston rod 64, rod 50 and rod string 18 to descend, the pressure in the chamber 58 is reduced (with hydraulic fluid being returned from the chamber to the power source 12).

In this example, the sensor 52 is attached externally to the housing 56. In other examples, the sensor 52 could be positioned internal to (or in a wall of) the housing 56, or the sensor 52 could be associated with the rod rotator 70 (see FIG. 1) to continuously detect a position of the rod 50 as it reciprocates. Thus, the scope of this disclosure is not limited to any particular position or orientation of the sensor 52.

A magnet 60 is attached to, and displaces with, the piston 54. A position of the magnet 60 (and, thus, of the piston 54) is continuously sensed by the sensor 52 during reciprocating displacement of the piston. A suitable magnet for use in the actuator 14 is a neodymium magnet (such as, a neodymium-iron-boron magnet) in ring form. However, other types and shapes of magnets may be used in keeping with the principles of this disclosure.

In other examples, the magnet 60 could be attached to, and displace with the rod 50 or another component of the rod rotator 70. The scope of this disclosure is not limited to any particular position of the magnet 60, or detection of the position of any particular component of the actuator 14 or rod rotator 70.

A suitable linear position sensor (or linear variable displacement transducer) for use as the sensor 52 in the system 10 is available from Rota Engineering Ltd. of Manchester, United Kingdom. Other suitable position sensors are available from Hans Turck GmbH & Co. KG of Germany, and from Balluff GmbH of Germany. However, the scope of this disclosure is not limited to use of any particular sensor or type of sensor with the system 10.

Figure 3:
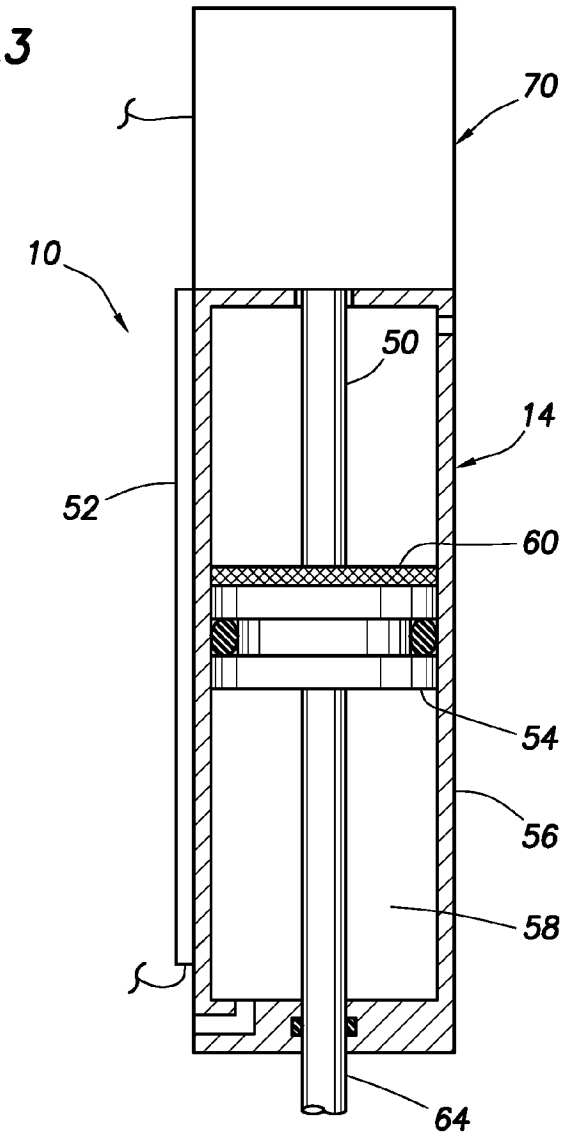
FIG. 3 is a representative partially cross-sectional view of another example of the actuator with a rod rotator.

Referring additionally now to FIG. 3, another example of the system 10 is representatively illustrated. In this example, the rod rotator 70 is positioned above the actuator 14, and the rod 50 is connected to the piston 54. In other examples, the rod rotator 70 could be effectively integrated with the actuator 14. Thus, it is not necessary for the rod rotator 70 to be a separate apparatus from the actuator 14, or to be separately connected to the actuator.

In the FIG. 3 example, the rod 50 is rotated by the rod rotator 70. Rotation of the rod 50 causes rotation of the piston 54, the piston rod 64 and the rod string 18 (see FIG. 1). Note that it is not necessary for the piston 54 to rotate (for example, the rod 50 could be connected to the piston rod 64 through the piston 54 using a sealed swivel device).

Figure 4:
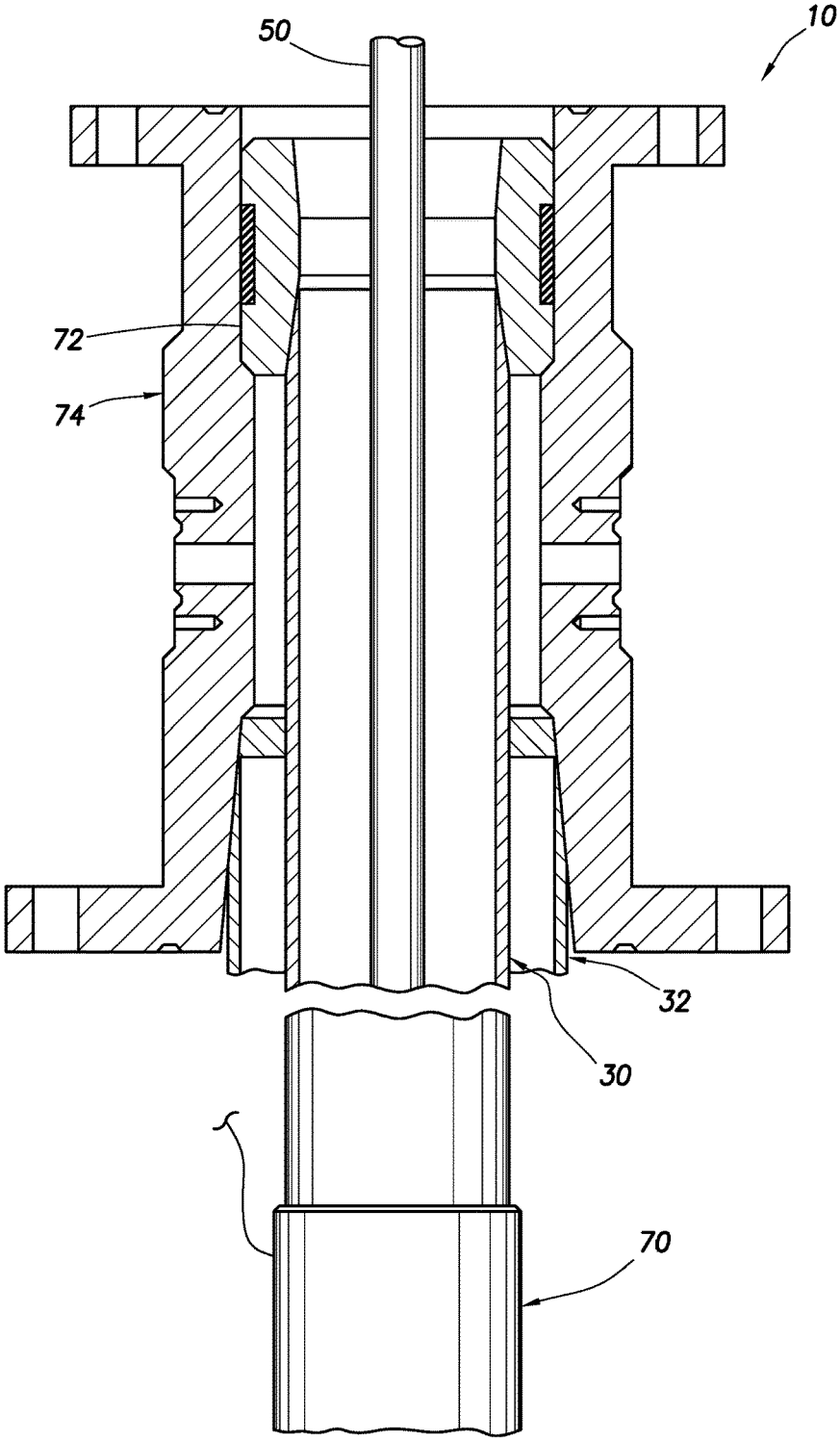
FIG. 4 is a representative cross-sectional view of another example of the rod rotator disposed below a tubing hanger.

Referring additionally now to FIG. 4, a technique is representatively illustrated for connecting the rod rotator 70 in the production tubing string 30 in another example of the system 10. In this example, the rod rotator 70 could form an upper section of the tubing string 30 and could be hung off in, or below, the wellhead 16 using a tubing hanger 72 in a tubing head 74.

FIG. 4 depicts production casing 32 also being suspended from the tubing head 74. However, in other examples the production casing 32 may be suspended from a separate casing head (not shown). Whether or not the casing 32 is suspended from the tubing head 74, suspending the rod rotator 70 from the tubing hanger 72 will typically result in the rod rotator being positioned completely, or at least partially, within the casing.

One advantage of the FIG. 4 example is that the rod rotator 70 is completely enclosed. Thus, the rod rotator 70 is protected from damage and a possibility that personnel could be injured by operation of the rod rotator is minimized. However, the scope of this disclosure is not limited to complete enclosure of the rod rotator 70, or to any particular configuration or positioning of the rod rotator.

Figure 5A:
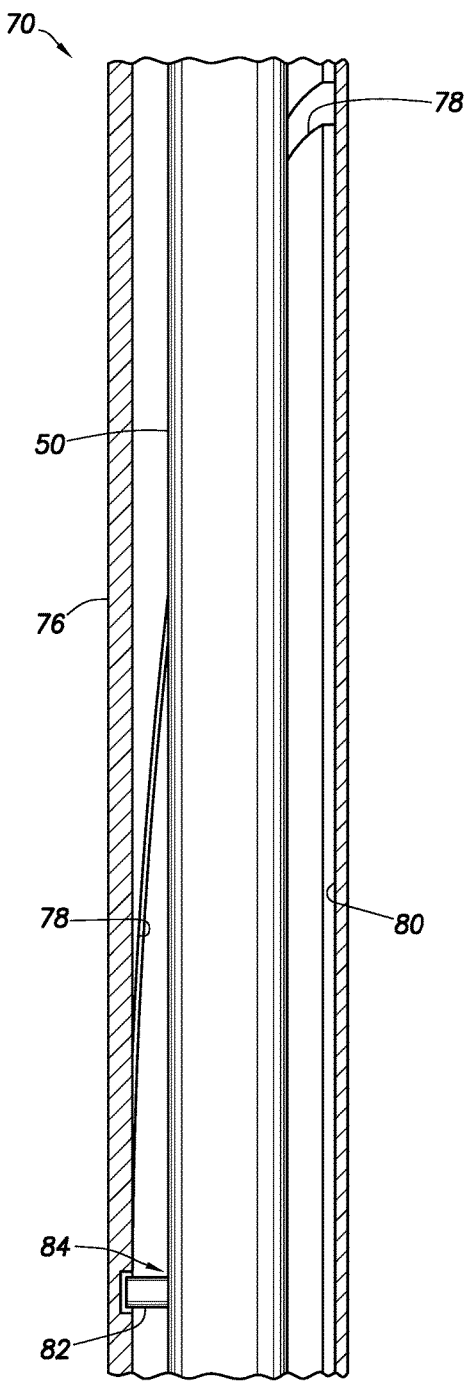
FIGS. 5A & B are representative partially cross-sectional views of alternate examples of the rod rotator.

Referring additionally now to FIGS. 5A & B, alternate examples of the rod rotator 70 are representatively illustrated. These and other examples of the rod rotator 70 described herein or depicted in the drawings may be positioned, such as, between the stuffing box 44 and the blowout preventer stack 42 as shown in FIG. 1, above or at a top of the actuator 14 as shown in FIG. 3, or below the tubing hanger 72 as shown in FIG. 4.

In the FIG. 5A example, a generally tubular outer housing 76 of the rod rotator 70 has two profiles 78, 80 therein. In this example, the profiles 78, 80 are in the form of slots or grooves, but in other examples the profiles could be tracks, rails or other types of profiles. Thus, the scope of this disclosure is not limited to any particular form or type of profiles.

The profile 78 extends helically along an interior of the housing 76. In this example, the profile 78 extends three hundred sixty degrees about the interior of the housing (only half of the profile is visible in FIG. 5A), but in other examples the profile could extend one hundred eighty, ninety, sixty or another number of degrees from its beginning to its end. Although only one helical profile 78 is depicted in FIG. 5A, any number may be used in keeping with the scope of this disclosure.

The profile 80 extends linearly along the interior of the housing 76. In this example, the linear profile 80 intersects the helical profile 78 (e.g., at an upper end of the helical profile), but in other examples the profiles may not intersect. Although only one linear profile 80 is depicted in FIG. 5A, any number may be used in keeping with the scope of this disclosure.

An engagement member 82 of an engagement device 84 carried with the rod 50 is engaged with the helical profile 78 when the rod 50 is at its lower stroke extent and as it strokes upward, as depicted in FIG. 5A. In this example, the engagement member 82 is in the form of a lug, dog or key that complementarily engages the profile 78, with the engagement member thus forming a "male" member and the profile forming a "female" member. However, in other examples the engagement member 82 could be a "female" member and the profile 78 could be a "male" member, or neither of the engagement member and profile may be configured as a "male" or a "female" member. Thus, the scope of this disclosure is not limited to any type or configuration of complementary engagement between engagement members and profiles.

The engagement member 82 extends outwardly from the rod 50 to engage the profile 78. The engagement device 84 can include various types of actuators (for example, electrical/solenoid, hydraulic, pneumatic, mechanical linkage, electro- or magneto-strictive, etc.) for displacing the engagement member 82 into or out of engagement with the profile 78. In some examples, the engagement member 82 may remain in engagement with the profile 78, in which case no actuator may be included with the engagement device 84.

Engagement between the member 82 and the helical profile 78 will cause the rod 50 to rotate as it displaces longitudinally relative to the outer housing 76. As depicted in FIG. 5A, the rod 50 will rotate as it strokes upwardly relative to the outer housing 76. In other examples, the rod 50 could instead rotate as it displaces downwardly, or the rod could rotate both as it displaces upwardly, and as it displaces downwardly.

Note that, as used herein, the term "helical" (and its variants, such as, "helically," "helix," etc.) is used to indicate a combination of rotational and longitudinal extension. It is not necessary for a ratio of rotational extension to longitudinal extension (for example, expressed as degrees of rotation per unit length) to be constant along a helix. In some examples of the rod rotator 70, it may be advantageous for the ratio of rotational extension to longitudinal extension of the helical profile 78 to be relatively small as the rod 50 begins to stroke, for the ratio to be increased midway through the stroke, and then for the ratio to decrease as the rod approaches an end of the stroke. Thus, the scope of this disclosure is not limited to any particular configuration or slope(s) of the helical profile 78.

In the FIG. 5A example, when the rod reaches its upper stroke extent, the engagement member 82 will engage the linear profile 80. Such engagement between the member 82 and the linear profile 80 will prevent the rotation previously imparted to the rod 50 during its upward displacement from being reversed during subsequent downward displacement of the rod.

It is expected that, although rotation of the rod 50 at or near the surface 40 will cause corresponding rotation of at least an upper section of the rod string 18, friction effects and elasticity of the rod string will result in a lower section of the rod string not being rotated as much as the upper section, with a torque thus remaining in the rod string. This torque could result in the rod 50 being rotated in an opposite direction if a mechanism is not provided for resisting this opposite rotation. The engagement between the member 82 and the linear profile 80 provides such a rotation resisting mechanism as the rod 50 strokes downward in the FIG. 5A example.

The engagement member 82 and profiles 78, 80 may be configured or shaped so that the engagement member traverses from the helical profile 78 to the linear profile 80, and then from the linear profile to the helical profile, and so on, repeatedly as the rod 50 reciprocates in the housing 76. Alternatively, or in addition, an actuator of the engagement device 84 may displace the member 82 in a manner causing the member to alternately engage the profiles 78, 80 for respective upward and downward strokes of the rod 50. Thus, the scope of this disclosure is not limited to any particular technique for causing or resisting rotation of the rod 50 by engagement between the member 82 and the profiles 78, 80, or to any particular technique for causing such engagement.

Figure 5B:
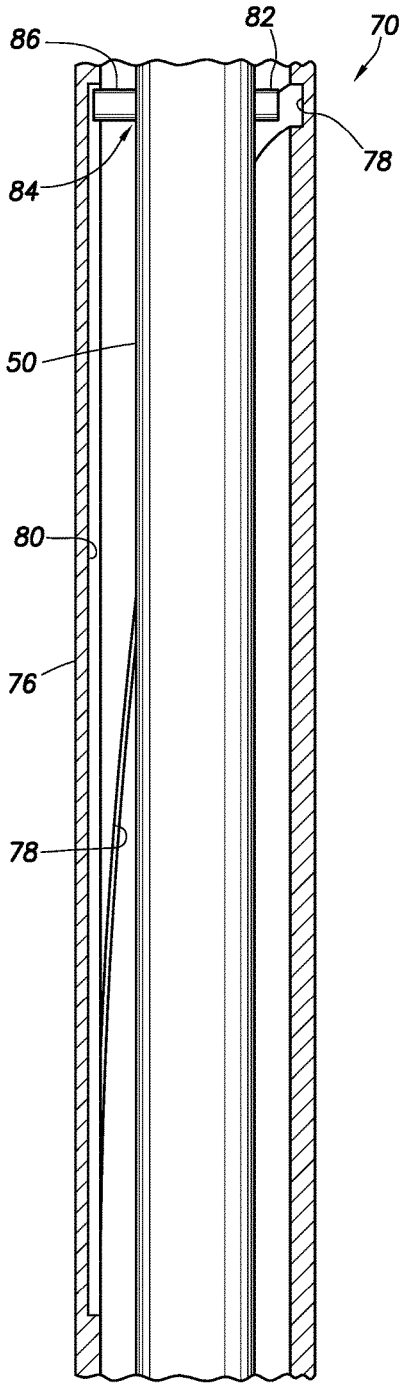

Referring specifically now to FIG. 5B, the rod 50 is depicted at its upper stroke extent. The rod 50 has been rotated during its upward displacement to the FIG. 5B position. This rotation has been imparted to at least the upper section of the rod string 18.

In the FIG. 5B example, the engagement device 84 includes another engagement member 86 that extends outwardly into engagement with the linear profile 80 positioned on an opposite side of the housing 76. The member 86 is extended into engagement with the linear profile 80, just before the member 82 is retracted out of engagement with the helical profile 78, when the rod 50 reaches its upper stroke extent. This timing can be controlled by the control system 46, or the engagement device 84 may be configured to automatically engage and disengage the members 82, 86 (some examples of automatic engagement are described more fully below).

Engagement between the member 86 and the linear profile 80 will ensure that the rod 50 does not rotate in a reverse direction as it displaces longitudinally downward. In this manner, more of the rod string 18 will be rotated during the downward stroke, and the torque in the rod string will be reduced or eliminated by the time the rod string again strokes upward.

Although the members 82, 86 are depicted in FIG. 5B as being included in the same engagement device 84, in other examples separate engagement devices may be provided for the members. Separate actuators may be provided for displacing the members 82, 86 individually, or a single actuator could displace both of the members. The members 82, 86 could be separate members, or they could be parts of a single integral structure. Thus, the scope of this disclosure is not limited to any particular construction, number or configuration of the engagement device 84 or its member(s) 82, 86.

Figure 6A:
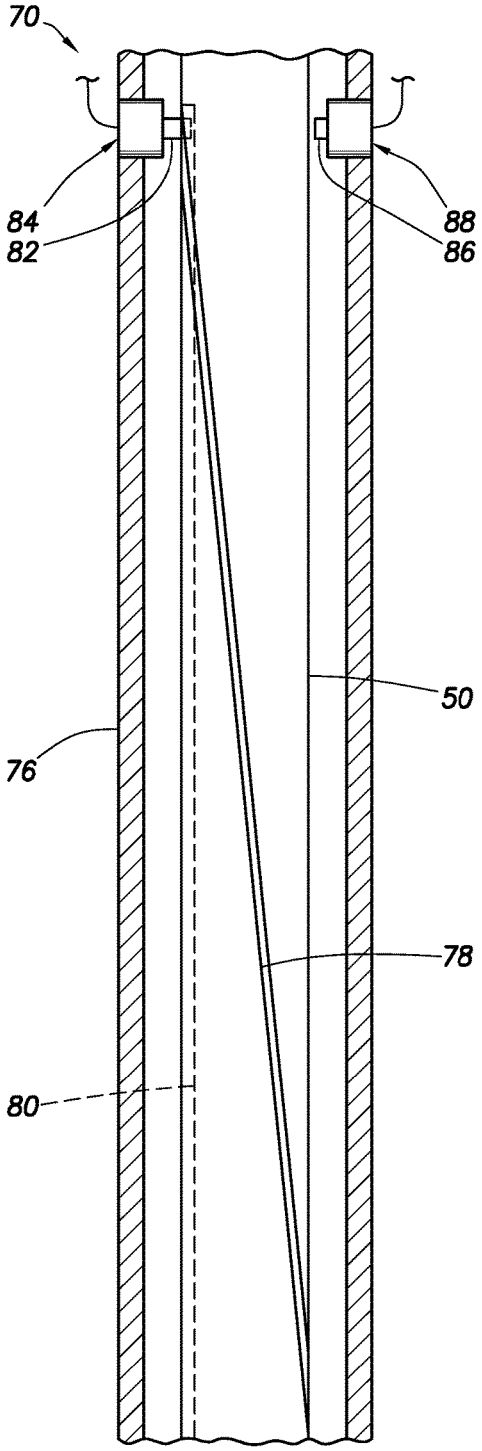
FIGS. 6A & B are representative partially cross-sectional views of another example of the rod rotator.

Referring additionally now to FIGS. 6A & B, another example of the rod rotator 70 is representatively illustrated. In FIG. 6A the rod 50 is depicted as it strokes upward, and in FIG. 6B the rod is depicted as it strokes downward.

The FIGS. 6A & B example differs in one respect from the FIGS. 5A & B examples, in that the profiles 78, 80 are formed on the rod 50, instead of the housing 76. Another difference is that two engagement devices 84, 88 are used, instead of one, and the engagement devices are mounted to the housing 76, instead of to the rod 50.

Thus, the FIGS. 6A & B example may be considered to be "inverted" as compared to the FIGS. 5A & B examples. It should, therefore, be appreciated that the scope of this disclosure is not limited to any particular relative positions of components (such as, one component being positioned inward, outward, above, below, integral to, or separate from, another component). Any of the examples described herein can be "inverted" or otherwise differently configured, in keeping with the principles of this disclosure.

As depicted in FIG. 6A, the member 82 is displaced by the engagement device 84 into engagement with the helical profile 78. As a result of this engagement, the rod 50 will be rotated as it displaces upward from its FIG. 6A position.

Figure 6B:
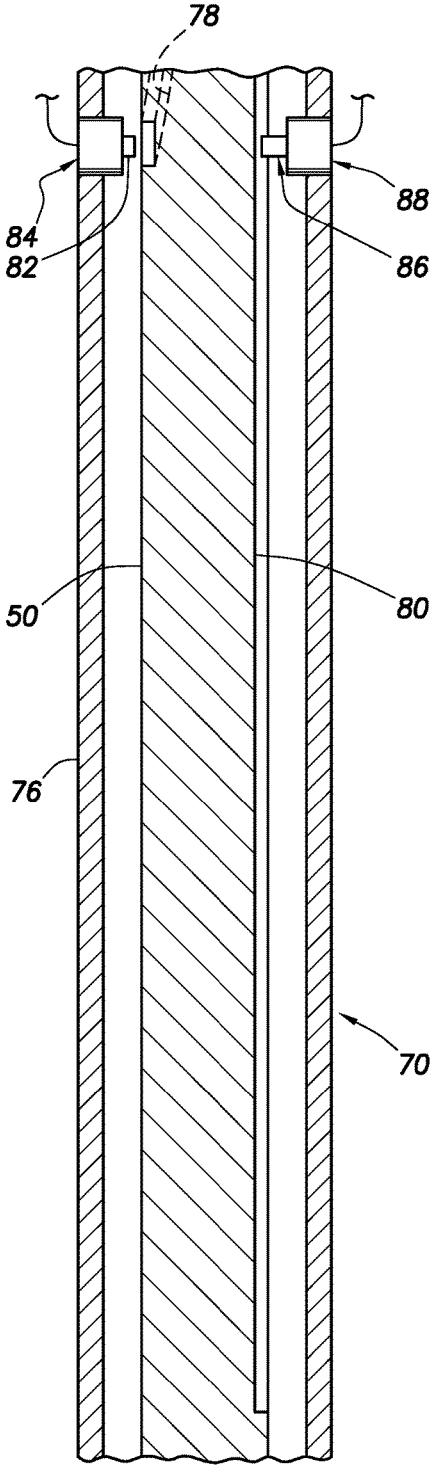

As depicted in FIG. 6B, the member 86 is displaced by the engagement device 88 into engagement with the linear profile 80. As a result of this engagement, the rod 50 will be prevented from rotating as it displaces downward.

At a lower stroke extent of the rod 50, the member 82 is preferably engaged with the helical profile 78 just before the member 86 is disengaged from the linear profile 80. At an upper stroke extent of the rod 50, the member 86 is preferably engaged with the linear profile 80 just before the member 82 is disengaged from the helical profile 78. This timing can be controlled by the control system 46 in response to the continuous position sensing provided by the sensor 52.

Figure 7:
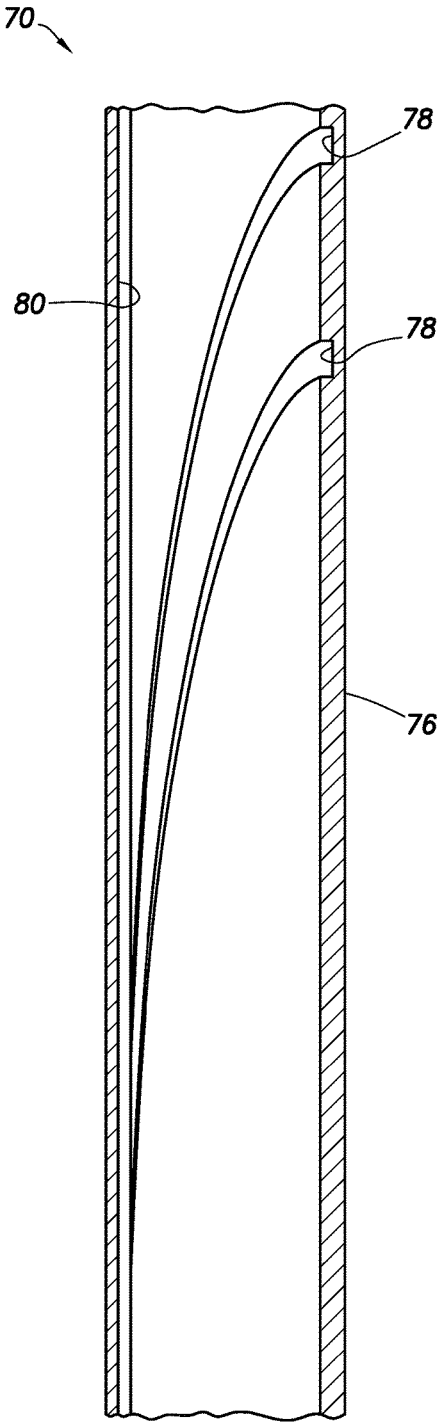
FIG. 7 is a representative cross-sectional view of an example of a housing of the rod rotator, the housing having multiple helical profiles therein.

Referring additionally now to FIG. 7, another example of the rod rotator outer housing 76 is representatively illustrated. In this example, multiple helical profiles 78 are formed in the housing 76. The profiles 78 are longitudinally distributed, but not necessarily spaced apart, since they could intersect (such as, at the linear profile 80).

By providing multiple profiles 78, different stroke extents of the rod 50 and rod string 18 can be accommodated. As discussed above, it may be advantageous to change the upper or lower stroke extent during operation to provide for changed conditions, optimizing performance, etc. If an upper or lower stroke extent is changed, the control system 46 can appropriately change the timing of the actuation of the engagement device 84, so that the member 82 engages a proper selected one of the profiles 78. Although only two profiles 78 are depicted in FIG. 7, any number of profiles may be used.

Figure 8:
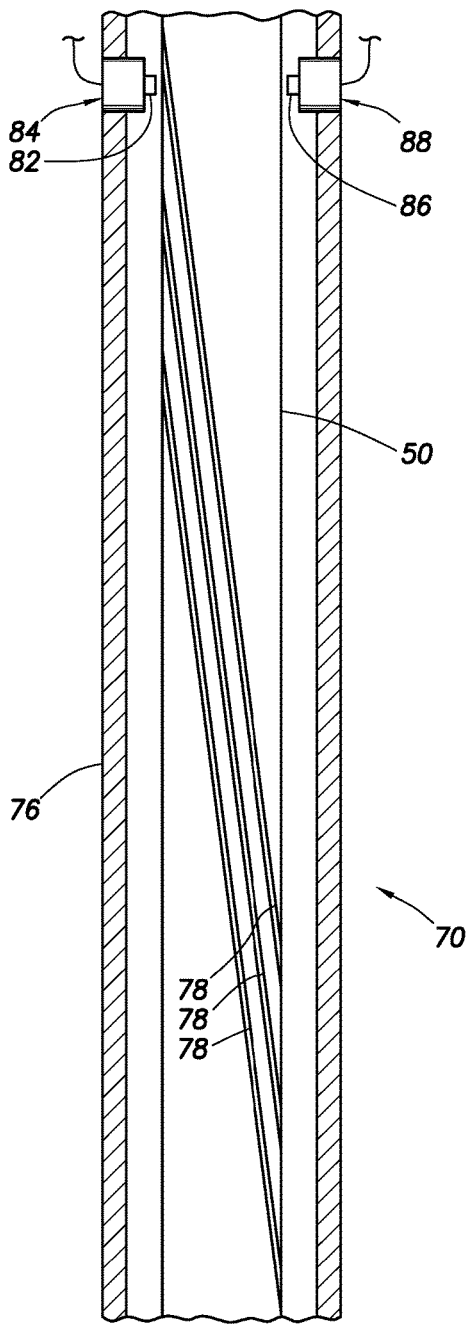
FIG. 8 is a representative partially cross-sectional view of another example of the rod rotator, a rod therein having multiple helical profiles thereon.

Referring additionally now to FIG. 8, another example of the rod rotator 70 is representatively illustrated. In this example, multiple helical profiles 78 are provided on the rod 50. As with the FIG. 7 example, the member 82 can be selectively engaged with different ones of the profiles 78, as needed to accommodate a change in upper or lower stroke extent of the rod 50 and rod string 18.

Figure 9A:
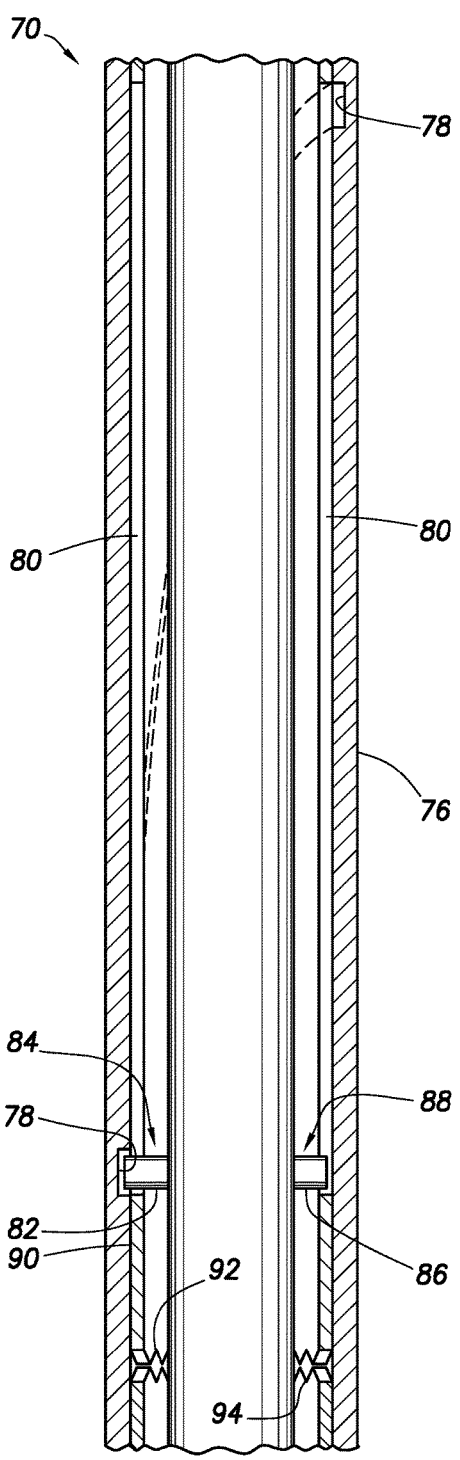
FIGS. 9A & B are representative partially cross-sectional views of another example of the rod rotator, with a rod therein being at respective lower and upper stroke extents.

Referring additionally now to FIGS. 9A & B, another example of the rod rotator 70 is representatively illustrated. In this example, two of the linear profiles 80 are formed as elongated openings or slots in a generally tubular body 90 positioned in an annular space formed radially between the rod 50 and the outer housing 76. The members 82, 86 remain engaged with the linear profiles 80 as the rod 50 reciprocates, and the members are alternately engaged with and disengaged from the helical profile 78, as described more fully below.

Figure 9B:
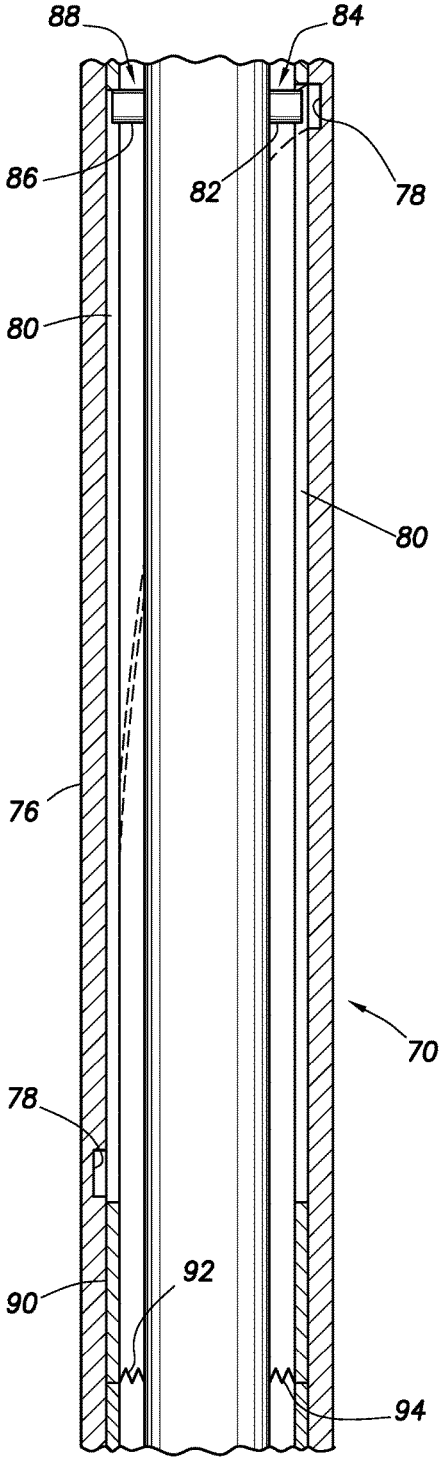

As depicted in FIG. 9A, a lower end of the body 90 has a "saw-tooth" profile 92 thereon for complementary engagement with another "saw-tooth" profile 94 formed in the housing 76. When the profiles 92, 94 are engaged (as depicted in FIG. 9B), the body 90 and the rod 50 are prevented from rotating relative to the housing 76. When the profiles 92, 94 are disengaged (as depicted in FIG. 9A), the body 90 and the rod 50 can rotate relative to the housing 76.

Note that other types of profiles or clutching arrangements may be used in place of the profiles 92, 94. For example, castellated profiles, electromechanical clutches, etc., may be used in other examples. The scope of this disclosure is not limited to use of any particular technique for alternately allowing and preventing rotation of the body 90 and rod 50 relative to the housing 76.

In FIG. 9A, the member 82 is engaged with the helical profile 78, and the profiles 92, 94 are disengaged. Upward displacement of the rod 50 causes the rod to rotate (due to the engagement between the member 82 and the profile 78), and also causes the body 90 to rotate (due to the engagement between the members 82, 86 and the profiles 80). The body 90 is permitted to rotate because of the disengagement of the profiles 92, 94.

In FIG. 9B, the member 82 is disengaged from the helical profile 78, and the profiles 92, 94 are engaged. The rod 50 can displace downward without reverse rotation (due to the engagement between the members 82, 86 and the profiles 80). The body 90 does not rotate because of the engagement between the profiles 92, 94.

The disengagement of the profiles 92, 94 when the rod 50 displaces upward, and the engagement of the profiles 92, 94 when the rod displaces downward may be a result of friction between the rod and the body 90. Alternatively, or in addition, rotational displacement of the member 82 due to its engagement with the helical profile 78 and one of the profiles 80 when the rod 50 displaces upward may cause disengagement of the profiles 92, 94, and gravity may cause engagement of the profiles 92, 94 when the rod 50 displaces downward. If an electromechanical or other clutching arrangement is used, the control system 46 could control the timing of prevention and allowance of rotation of the body 90 relative to the housing 76. Thus, the scope of this disclosure is not limited to any particular technique or cause for selective allowance and prevention of relative rotation between the body 90 and the housing 76.

Figure 10A:
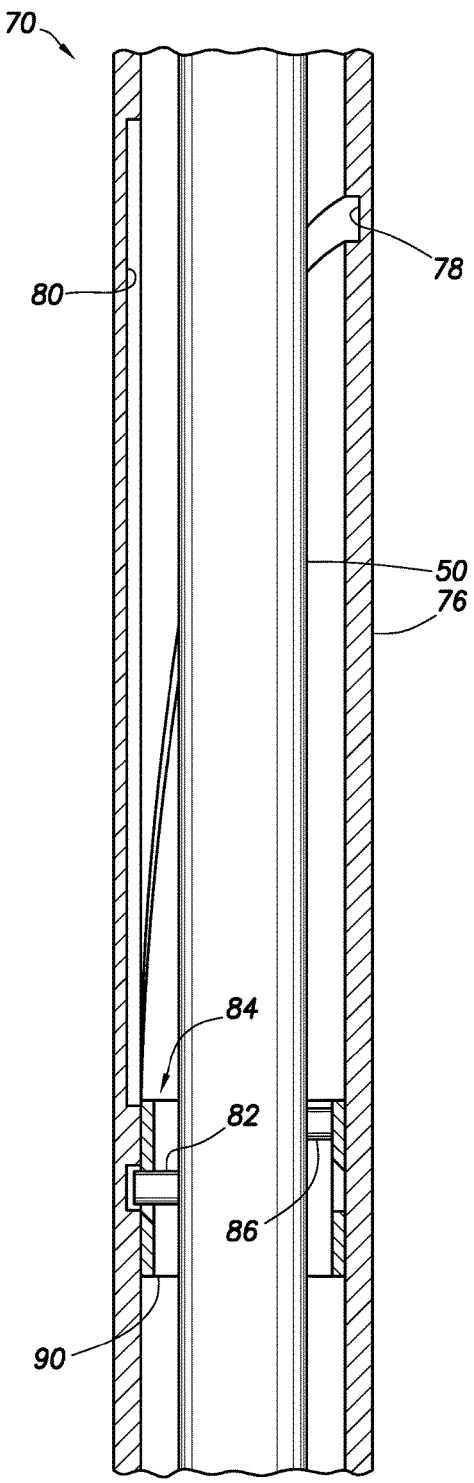
FIGS. 10A & B are representative partially cross-sectional views of another example of the rod rotator, with respective upward and downward displacement of the rod therein.

Referring additionally now to FIGS. 10A & B, another example of the rod rotator 70 is representatively illustrated. In this example, the engagement device 84 extends and retracts the members 82, 86 in response to upward and downward displacement of the rod 50. The body 90 in this example can be considered a component of the engagement device 84.

As depicted in FIG. 10A, the rod 50 begins to displace upward. The member 82 is engaged with the helical profile 78, and so the rod 50 will rotate as it displaces upward. The member 86 is retracted, due to a position of the body 90 relative to the rod 50. When the rod 50 displaces upward, the body 90 shifts downward relative to the rod, thereby allowing the member 82 to extend outward (e.g., with a biasing device, such as a compression spring, biasing the member 82 outward), and thereby retracting the member 86 inward. Such downward shifting of the body 90 relative to the rod 50 may be due to gravity, friction between the body and the housing 76, or another cause.

Figure 10B:
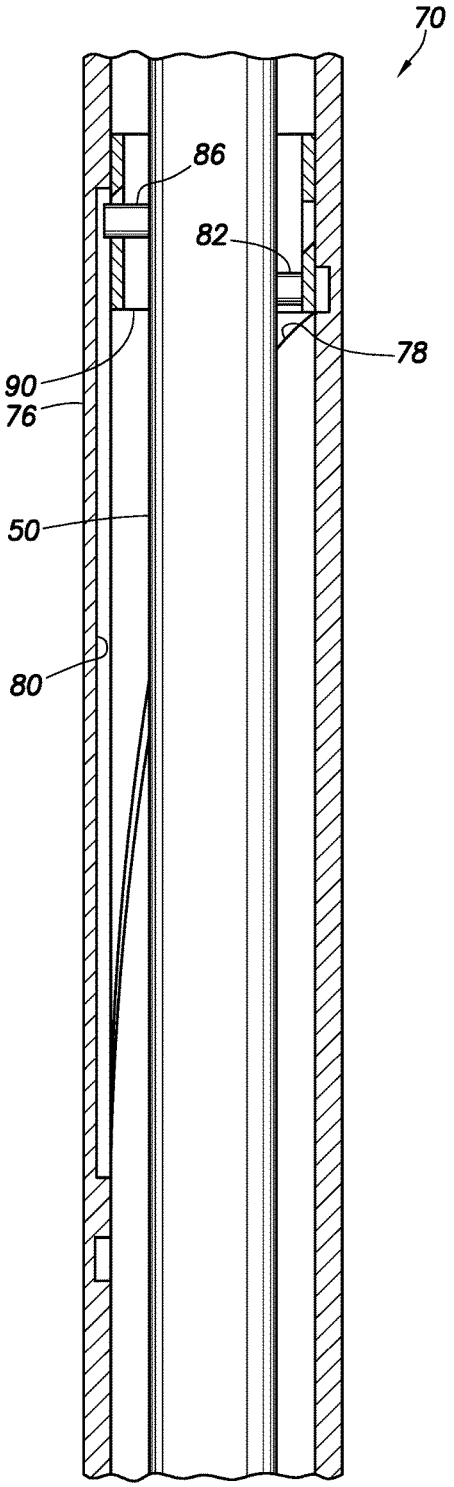

As depicted in FIG. 10B, the rod 50 begins to displace downward. In response to the downward displacement of the rod 50, the body 90 shifts upward relative to the rod. As a result, the member 86 is extended outward into engagement with the linear profile 80, and the member 82 is retracted out of engagement with the helical profile 78. Therefore, the rod 50 will displace downward without any rotation.

Preferably, at an upper stroke extent of the rod 50, the member 86 engages the linear profile 80 prior to the member 82 disengaging from the helical profile 78. Conversely, at a lower stroke extent, the member 82 preferably engages the helical profile 78 prior to the member 86 disengaging from the linear profile 80.

Referring additionally now to FIGS. 11A-12B, another example of the rod rotator 70 is representatively illustrated. In this example, similar somewhat to the FIGS. 10A & B example, relative displacement between the body 90 and the rod 50 causes engagement and disengagement between the members 82, 86 and the profiles 78, 80.

Figure 11A:
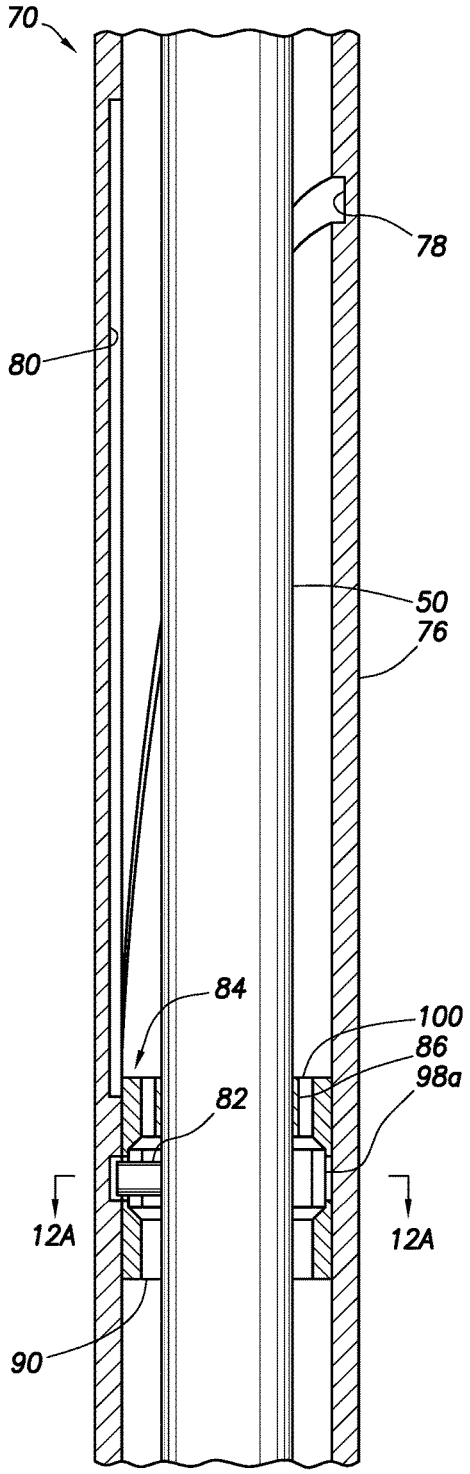
FIGS. 11A & B are representative partially cross-sectional views of another example of the rod rotator, with respective upward and downward displacement of the rod therein.
Figure 12A:
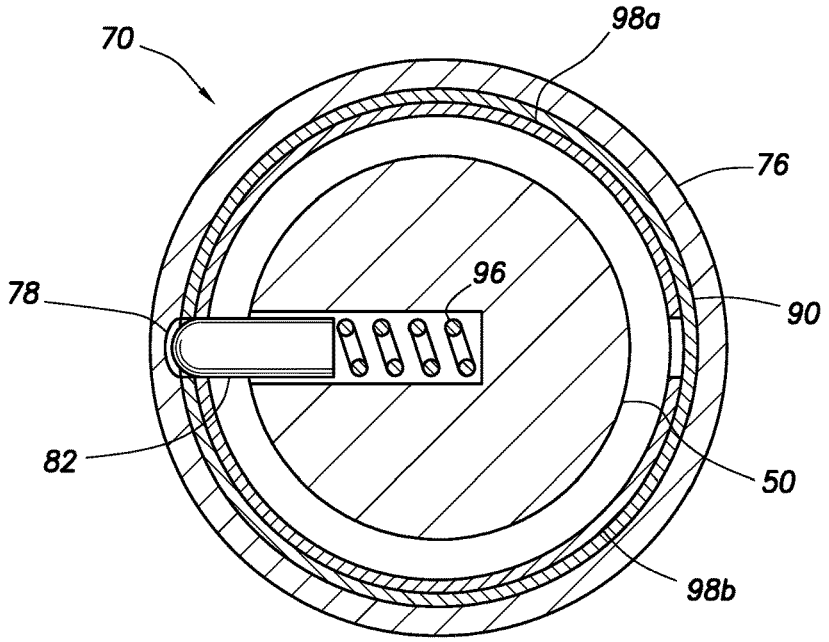
FIGS. 12A & B are representative cross-sectional views of the rod rotator of FIGS. 11A & B, taken along line 12A-12A of FIG. 11A.

As depicted in FIGS. 11A & 12A, the rod 50 begins to displace upward. The member 82 is engaged with the helical profile 78, and so the rod 50 will rotate as it displaces upward. The member 86 is retracted, due to a position of the body 90 relative to the rod 50. When the rod 50 displaces upward, the body 90 shifts downward relative to the rod, thereby allowing the member 82 to extend outward (due to a biasing force exerted by a compression spring 96, biasing the member 82 outward), and thereby retracting the member 86 inward. Such downward shifting of the body 90 relative to the rod 50 may be due to gravity, friction between the body and the housing 76, or another cause.

In this position of the body 90 relative to the rod 50, cylindrical segments 98*a,b* are received in a radially enlarged inner diameter of the body, and the segments are allowed to spread apart. Thus, the member 82 can extend outwardly between the segments 98*a,b*, through an opening in the body 90, and engage the profile 78 (see FIG. 12A). Similar cylindrical segments 100 are received in a radially reduced inner diameter of the body 90, and the segments are compressed inward, thereby retracting the member 86.

Figure 11B:
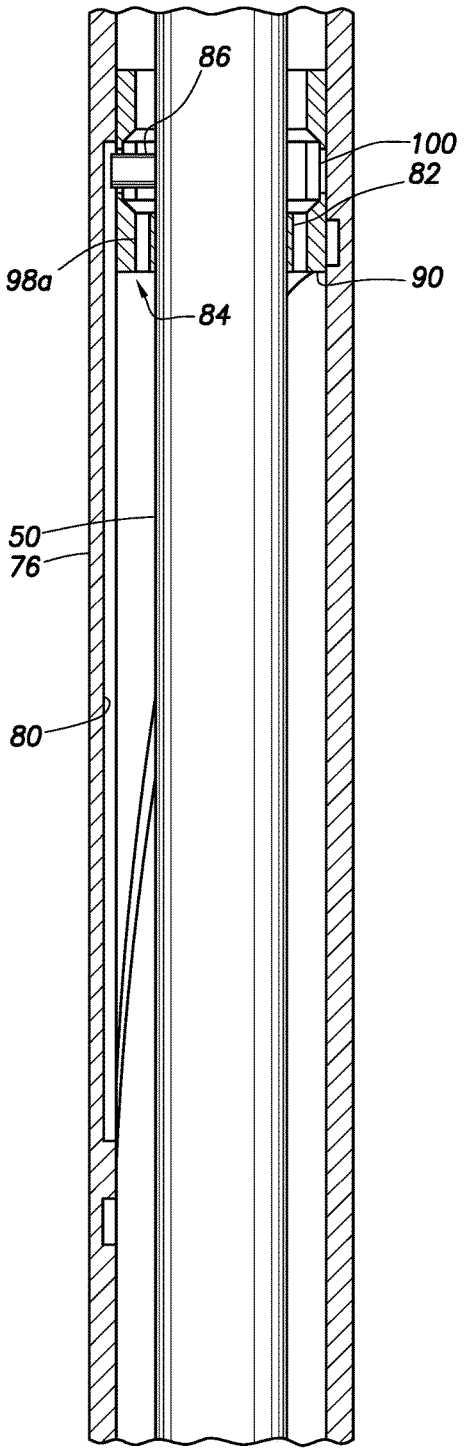
Figure 12B:
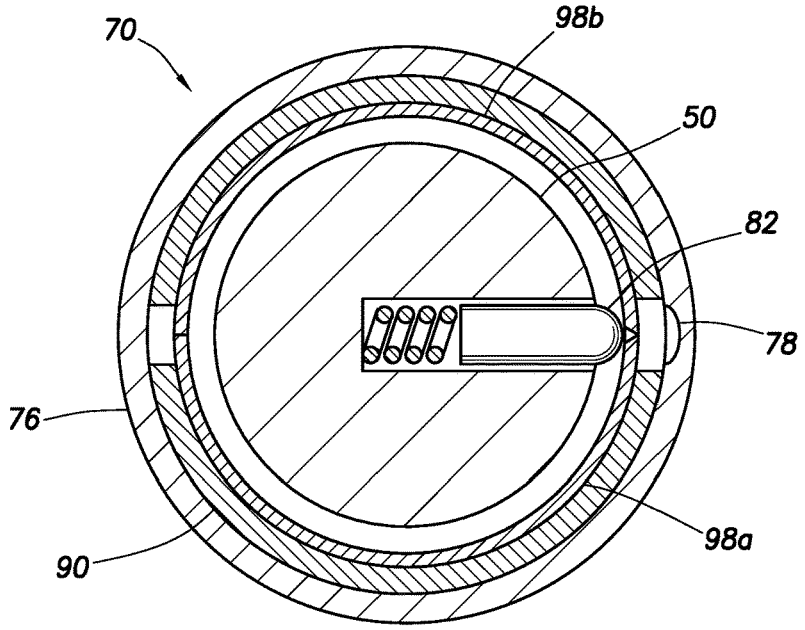

As depicted in FIGS. 11B & 12B, the rod 50 begins to displace downward. In response to the downward displacement of the rod 50, the body 90 shifts upward relative to the rod. As a result, the member 86 is extended outward into engagement with the linear profile 80, and the member 82 is retracted out of engagement with the helical profile 78. Therefore, the rod 50 will displace downward without any rotation.

In this position of the body 90 relative to the rod 50, the cylindrical segments 98*a,b* are received in a radially reduced inner diameter of the body, and the segments are compressed inward. Thus, the member 82 is retracted out of engagement with the profile 78 (see FIG. 12B). The cylindrical segments 100 are received in a radially enlarged inner diameter of the body 90, and the segments are allowed to spread apart, thereby allowing the member 86 to extend outwardly between the segments 100, through an opening in the body 90, and engage the profile 80.

Although multiple segments 98*a,b* are depicted for extending and retracting the member 82, it will be appreciated that a single C-shaped structure could be used instead, and a resiliency of the structure could bias the structure toward an "open" configuration. A similar structure could also be used for the segments 100 to extend and retract the member 86. Thus, the scope of this disclosure is not limited to any particular technique or configuration for extending and retracting the members 82, 86.

Preferably, at an upper stroke extent of the rod 50, the member 86 engages the linear profile 80 prior to the member 82 disengaging from the helical profile 78. Conversely, at a lower stroke extent, the member 82 preferably engages the helical profile 78 prior to the member 86 disengaging from the linear profile 80.

Referring additionally now to FIGS. 13A-14B, another example of the rod rotator 70 is representatively illustrated. In this example, the body 90 can displace relative to the rod 50 and the housing 76. Engagement and disengagement between the members 82, 86 and the profiles 78, 80, as well as gripping engagement between grips 102, 104 and the rod 50, are controlled by displacement of plungers 106, 108 in response to contact with abutments 110, 112 in the housing 76.

Figure 13A:
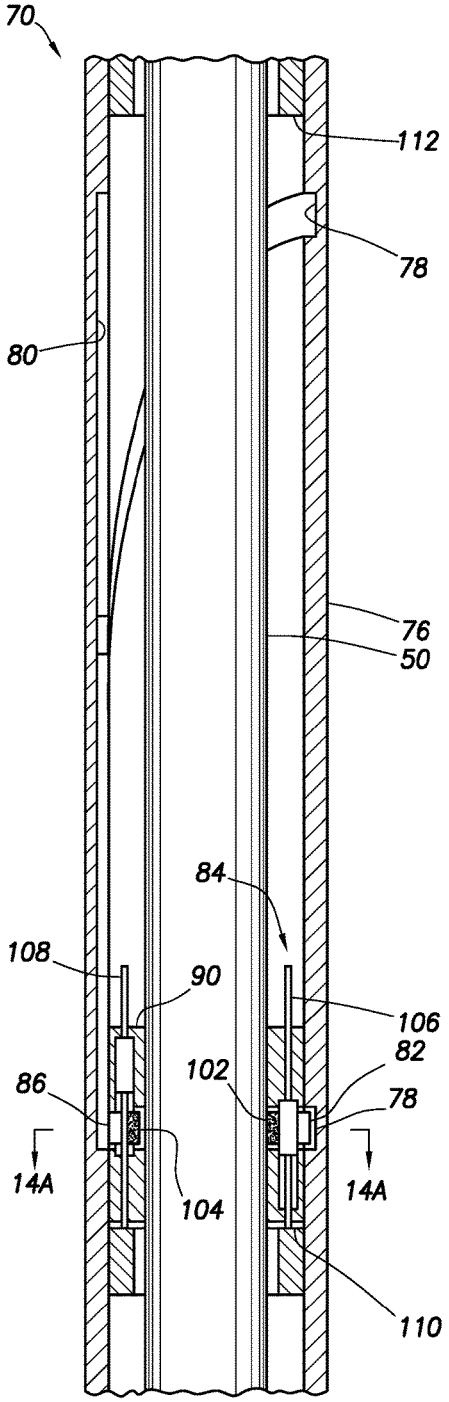
FIGS. 13A & B are representative partially cross-sectional views of another example of the rod rotator, with a rod therein being at respective lower and upper stroke extents.
Figure 14A:
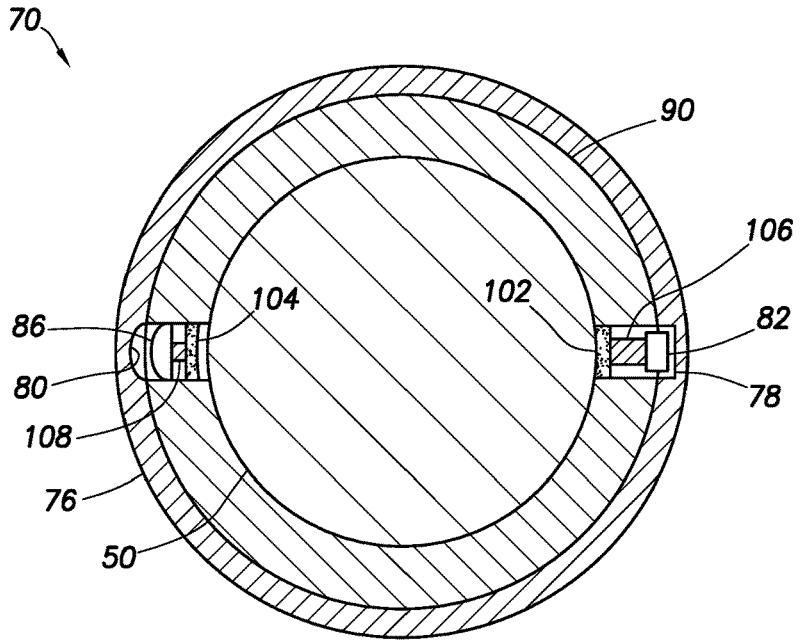
FIGS. 14A & B are representative cross-sectional views of the rod rotator of FIGS. 13A & B, taken along line 14A-14A of FIG. 13A.

As depicted in FIGS. 13A & 14A, the rod 50 is at its lower stroke extent. The plungers 106, 108 have contacted the abutment 110 and are in their upper positions relative to the body 90. In this position of the plunger 106, an increased thickness section of the plunger 106 is positioned between the member 82 and the grip 102. The member 82 is extended outwardly through the body 90 and into engagement with the helical profile 78. The grip 102 is extended inward into gripping engagement with the rod 50.

In this position of the plunger 108, a decreased thickness section of the plunger 108 is positioned between the member 86 and the grip 104. The member 86 is retracted inward out of engagement with the linear profile 80. The grip 104 is retracted out of engagement with the rod 50. When the rod 50 displaces upward, the engagement between the member 82 and the profile 78, and the gripping engagement between the grip 102 and the rod 50, will cause the rod to rotate.

Figure 13B:
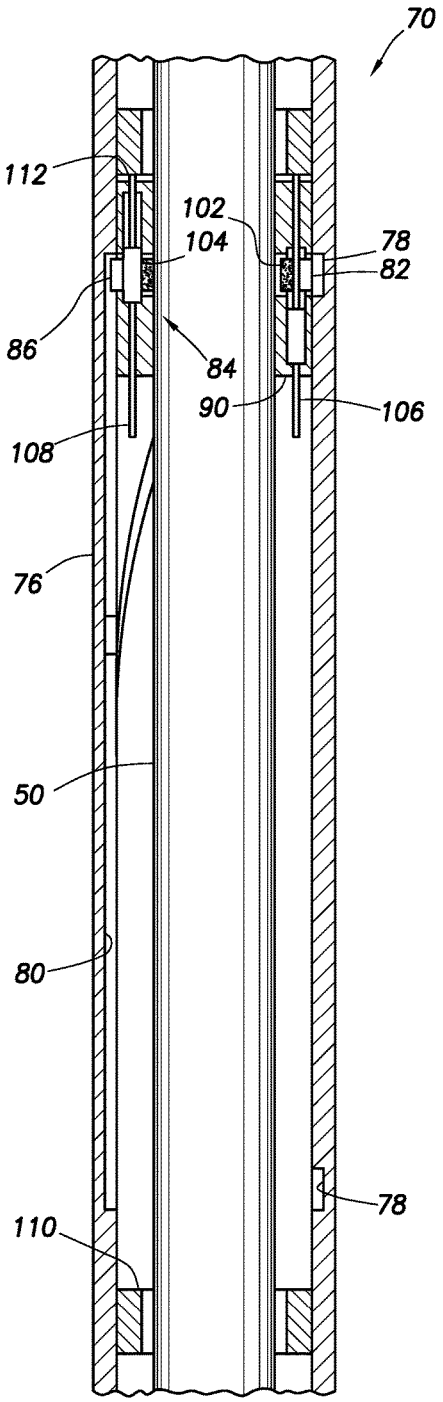
Figure 14B:
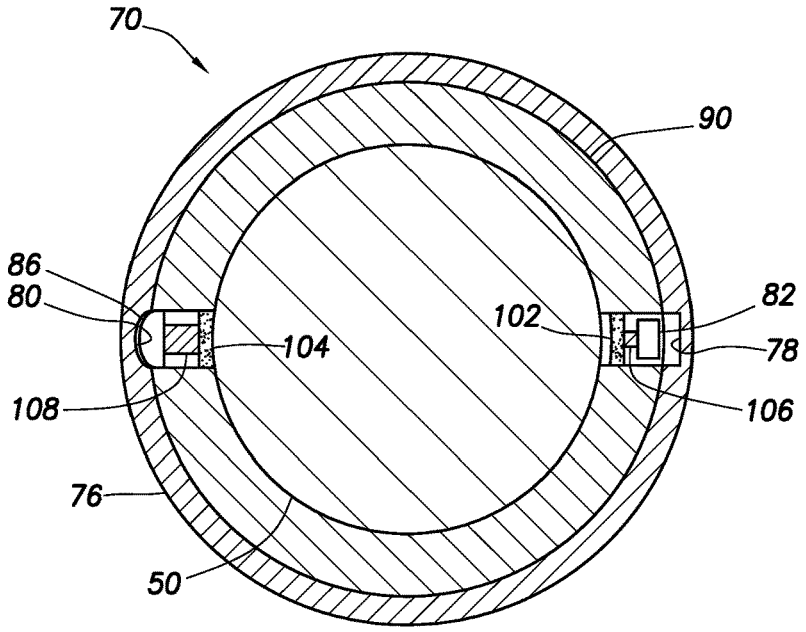

As depicted in FIGS. 13B & 14B, the rod 50 is at its upper stroke extent. the plungers 106, 108 have contacted the abutment 112 and are in their lower positions relative to the body 90. In this position of the plunger 106, a decreased thickness section of the plunger 106 is positioned between the member 82 and the grip 102. The member 82 is retracted inward out of engagement with the helical profile 78. The grip 102 is retracted out of engagement with the rod 50.

In this position of the plunger 108, an increased thickness section of the plunger 108 is positioned between the member 86 and the grip 104. The member 86 is extended outwardly through the body 90 and into engagement with the linear profile 80. The grip 104 is extended inward into gripping engagement with the rod 50. When the rod 50 displaces downward, the engagement between the member 86 and the profile 80, and the gripping engagement between the grip 104 and the rod 50, will prevent rotation of the rod.

Preferably, at the upper stroke extent of the rod 50 (as depicted in FIGS. 13A & 14A), the member 86 engages the linear profile 80, and the grip 104 engages the rod, prior to the member 82 disengaging from the helical profile 78 and the grip 102 disengaging from the rod. Conversely, at the lower stroke extent (as depicted in FIGS. 13B & 14B), the member 82 preferably engages the helical profile 78, and the grip 102 engages the rod 50, prior to the member 86 disengaging from the linear profile 80 and the grip 104 disengaging from the rod.

Although in examples described above, the rod 50 is rotated as it strokes upward, and is prevented from rotating as it strokes downward, in other examples these directions could be reversed (i.e., the rod rotating as it strokes downward, but not as it strokes upward). In some examples, the rod 50 could rotate in both upward and downward directions (e.g., by providing oppositely directed helical profiles in the rod rotator 70).

It may now be fully appreciated that the above disclosure provides significant advancements to the art of rotating a rod string in a well during reciprocating rod pumping operations. In various examples described above, the rod rotator 70 has a fully enclosed mechanism for reliable and efficient rotation of the rod string 18.

A well pumping system 10 is provided to the art by the above disclosure. In one example, the system 10 comprises an actuator 14 that reciprocates a rod string 18, and a rod rotator 70 including at least one helical profile 78 and at least a first engagement device 84. The rod string 18 rotates in response to longitudinal displacement of the rod string 18 while the first engagement device 84 is engaged with the helical profile 78.

The actuator 14 may be disposed between the rod rotator 70 and a wellhead 16. A tubing hanger 72 can be disposed between the actuator 14 and the rod rotator 70. The rod rotator 70 may be disposed within a casing 32.

The rod rotator 70 may include at least one linear profile 80. The first engagement device 84 can engage the helical profile 78 when the rod string 18 longitudinally displaces in one direction, and the first engagement device 84 can engage the linear profile 80 when the rod string 18 longitudinally displaces in an opposite direction.

The rod rotator 70 may include a second engagement device 88. The first engagement device 84 can engage the helical profile 78 when the rod string 18 longitudinally displaces in one direction, and the second engagement device 88 can engage the linear profile 80 when the rod string 18 longitudinally displaces in an opposite direction.

The linear profile 80 can prevent rotation of a rod 50 in the rod rotator 70 when the first engagement device 84 is disengaged from the helical profile 78.

The rod rotator 70 may include a body 90 disposed in an annular space formed radially between a rod 50 and a housing 76. The linear profile 80 may displace with the body 90.

The body 90 may rotate relative to the rod 50 or the housing 76 when the rod string 18 longitudinally displaces in one direction. The body 90 may be prevented from rotation relative to the rod 50 and the housing 76 when the rod string 18 longitudinally displaces in an opposite direction.

The system 10 may comprise multiple helical profiles 78. The multiple helical profiles 78 can be longitudinally distributed in the rod rotator 70. The first engagement device 84 may selectively engage different ones of the helical profiles 78 in response to corresponding changes in stroke extents of the rod string 18.

The rod rotator 70 may include a body 90 disposed in an annular space formed radially between a rod 50 and a housing 76, with a first engagement member 82 of the first engagement device 84 extending through the body 90. Longitudinal reciprocation of the body 90 may cause the first engagement member 82 to alternately engage and disengage the helical profile 78.

The rod rotator 70 may include a linear profile 80 and a second engagement device 88. The first engagement member 82 can disengage from the helical profile 78 when a second engagement member 86 of the second engagement device 88 engages the linear profile 80, and the second engagement member 86 can disengage from the linear profile 80 when the first engagement member 82 is engaged with the helical profile 78.

The first engagement member 82 may engage the helical profile 78 in response to displacement of the rod string 18 to one stroke extent, and the first engagement member 82 may disengage from the helical profile 78 in response to displacement of the rod string 18 to an opposite stroke extent.

The rod rotator 70 may include a first grip 102 that displaces with the body 90. The first grip 102 can engage the rod 50 in response to displacement of the rod string 18 to the first stroke extent, and the first grip 102 can disengage from the rod 50 in response to displacement of the rod string 18 to the second, opposite stroke extent. The rod rotator 70 may include a second grip 104 that displaces with the body 90, the first grip 102 disengaging from the rod 50 when the second grip 104 engages the rod 50, and the second grip 104 disengaging from the rod 50 when the first grip 102 engages the rod 50.

A method of rotating a rod string 18 in a well is also provided to the art by the above disclosure. In one example, the method comprises: rotating a rod 50 in one rotary direction, in response to displacement of the rod 50 in a first longitudinal direction; and preventing rotation of the rod 50 in an opposite rotary direction, in response to displacement of the rod 50 in a second longitudinal direction opposite to the first longitudinal direction.

The rotating step can include at least a first engagement device 84 engaging at least one helical profile 78. The rod string 18 may rotate in response to displacement of the rod 50 in the first longitudinal direction while the first engagement device 84 is engaged with the helical profile 78.

The preventing rotation step can include the first engagement device 84 engaging a linear profile 80 when the rod 50 displaces in the second longitudinal direction. The preventing rotation step can include a second engagement device 88 engaging a linear profile 80 when the rod 50 displaces in the second longitudinal direction. The preventing rotation step can include a linear profile 80 preventing rotation of the rod 50 when the first engagement device 84 is disengaged from the helical profile 78.

The method may include the first engagement device 84 selectively engaging different ones of multiple helical profiles 78 in response to corresponding changes in stroke extents of the rod string 18. The multiple helical profiles 78 may be longitudinally distributed.

The method may include disposing a body 90 in an annular space formed radially between the rod 50 and a housing 76. A first engagement member 82 of the first engagement device 84 may extend through the body 90.

The method may include the first engagement member 82 alternately engaging and disengaging the helical profile 78 in response to longitudinal reciprocation of the body 90.

The method may include the first engagement member 82 disengaging from the helical profile 78 when a second engagement member 86 engages a linear profile 80, and the second engagement member 86 disengaging from the linear profile 80 when the first engagement member 82 is engaged with the helical profile 78.

The method may include the first engagement member 82 engaging the helical profile 78 in response to displacement of the rod 50 to a first stroke extent, and the first engagement member 82 disengaging from the helical profile 78 in response to displacement of the rod 50 to a second stroke extent opposite to the first stroke extent.

The method may include the first engagement member 82 disengaging from the helical profile 78 when a second engagement member 86 of a second engagement device 88 engages a linear profile 80, and the second engagement member 86 disengaging from the linear profile 80 when the first engagement member 82 is engaged with the helical profile 78.

The method may include a first grip 102 engaging the rod 50 in response to displacement of the rod 50 to the first stroke extent, and the first grip 102 disengaging from the rod 50 in response to displacement of the rod to the second stroke extent. The method may include the first grip 102 disengaging from the rod 50 when a second grip 104 engages the rod 50, and the second grip 104 disengaging from the rod 50 when the first grip 102 engages the rod.

The method may include disposing a body 90 in an annular space formed radially between the rod 90 and a housing 76. A linear profile 80 may displace with the body 90.

The body 90 may rotate relative to the rod 50 or the housing 76 when the rod 50 displaces in the first longitudinal direction, and the body 90 may be prevented from rotation relative to the rod 50 and the housing 76 when the rod displaces in the second longitudinal direction.

The method may include disposing the actuator 14 between a wellhead 16 and a rod rotator 70 that rotates the rod 50. The method may include disposing a tubing hanger 72 between the actuator 14 and the rod rotator 70. The method may include disposing the rod rotator 70 within a casing 32.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well pumping system, comprising:

an actuator that reciprocates a rod string; and a rod rotator including at least one helical profile and at least a first engagement device, wherein the rod string rotates in response to longitudinal displacement of the rod string while the first engagement device is engaged with the helical profile.

2. The system of claim 1, wherein the actuator is disposed between the rod rotator and a wellhead.

3. The system of claim 1, wherein a tubing hanger is disposed between the actuator and the rod rotator.

4. The system of claim 1, wherein the rod rotator is disposed within a casing.

5. The system of claim 1, wherein the rod rotator further includes at least one linear profile.

6. The system of claim 5, wherein the first engagement device engages the helical profile when the rod string longitudinally displaces in a first direction, and the first engagement device engages the linear profile when the rod string longitudinally displaces in a second direction opposite to the first direction.

7. The system of claim 5, wherein the rod rotator further includes a second engagement device, the first engagement device engages the helical profile when the rod string longitudinally displaces in a first direction, and the second engagement device engages the linear profile when the rod string longitudinally displaces in a second direction opposite to the first direction.

8. The system of claim 5, wherein the linear profile prevents rotation of a rod in the rod rotator when the first engagement device is disengaged from the helical profile.

9. The system of claim 5, wherein the rod rotator further includes a body disposed in an annular space formed radially between a rod and a housing, and wherein the linear profile displaces with the body.

10. The system of claim 9, wherein the body rotates relative to one of the rod and the housing when the rod string longitudinally displaces in a first direction, and wherein the body is prevented from rotation relative to the rod and the housing when the rod string longitudinally displaces in a second direction opposite to the first direction.

11. The system of claim 1, wherein the at least one helical profile comprises multiple helical profiles.

12. The system of claim 11, wherein the helical profiles are longitudinally distributed in the rod rotator.

13. The system of claim 11, wherein the first engagement device selectively engages different ones of the helical profiles in response to corresponding changes in stroke extents of the rod string.

14. The system of claim 1, wherein the rod rotator further includes a body disposed in an annular space formed radially between a rod and a housing, and a first engagement member of the first engagement device extends through the body.

15. The system of claim 14, wherein longitudinal reciprocation of the body causes the first engagement member to alternately engage and disengage the helical profile.

16. The system of claim 15, wherein the rod rotator further includes a linear profile and a second engagement device, the first engagement member is disengaged from the helical profile when a second engagement member of the second engagement device engages the linear profile, and the second engagement member disengages from the linear profile when the first engagement member is engaged with the helical profile.

17. The system of claim 14, wherein the first engagement member engages the helical profile in response to displacement of the rod string to a first stroke extent, and the first engagement member disengages from the helical profile in response to displacement of the rod string to a second stroke extent opposite to the first stroke extent.

18. The system of claim 17, wherein the rod rotator further includes a linear profile and a second engagement device, the first engagement member is disengaged from the helical profile when a second engagement member of the second engagement device engages the linear profile, and the second engagement member disengages from the linear profile when the first engagement member is engaged with the helical profile.

19. The system of claim 17, wherein the rod rotator further includes at least a first grip that displaces with the body, the first grip engages the rod in response to displacement of the rod string to the first stroke extent, and the first grip disengages from the rod in response to displacement of the rod string to the second stroke extent.

20. The system of claim 19, wherein the rod rotator further comprises a second grip that displaces with the body, the first grip disengages from the rod when the second grip engages the rod, and the second grip disengages from the rod when the first grip engages the rod.

* * * * *